US006237868B1

(12) United States Patent
Shore et al.

(10) Patent No.: US 6,237,868 B1
(45) Date of Patent: May 29, 2001

(54) COOLING POT WITH VERTICALLY ADJUSTABLE COIL PLATE

(75) Inventors: T. Michael Shore, Princeton; Melicher Puchovsky, Dudley, both of MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 09/416,658

(22) Filed: Oct. 12, 1999

Related U.S. Application Data

(60) Provisional application No. 60/106,274, filed on Oct. 30, 1998.

(51) Int. Cl.[7] ..... B21C 47/04
(52) U.S. Cl. ..... 242/360; 242/363
(58) Field of Search ..... 242/360, 361.4, 242/361.5, 362, 362.1, 362.2, 362.3, 363, 361.1, 361.2, 361.3

(56) References Cited

U.S. PATENT DOCUMENTS

| | | | | |
|---|---|---|---|---|
| 2,929,493 | * | 3/1960 | Henning | 242/362 |
| 3,088,690 | * | 5/1963 | Haugwitz | 242/361.1 |
| 3,735,938 | * | 5/1973 | Coopman | 242/363 |
| 4,437,620 | * | 3/1984 | Ozawa | 242/362.2 |
| 5,190,236 | * | 3/1993 | Groos et al. | 242/361.3 |
| 5,501,410 | * | 3/1996 | Starvaski | 242/361.3 |
| 5,823,456 | * | 10/1998 | Bordignon et al. | 242/361.2 |

* cited by examiner

*Primary Examiner*—John M. Jillions
(74) *Attorney, Agent, or Firm*—Samuels, Gauthier & Stevens

(57) ABSTRACT

An apparatus for receiving a continuous series of rings of a hot rolled product includes:

a) a portable container having:
   i) a vertically disposed cylindrical side wall open at its upper and lower ends;
   ii) a base at the lower end of the side wall configured to removably locate the container at a coil forming station;
   iii) a horizontal shelf projecting inwardly from the interior of the side wall; and
   iv) a central core supported by the shelf, the core being spaced inwardly from the interior of the side wall to define an annular chamber therebetween, the shelf having access openings therein communicating with the chamber;

b) an elevator platform at the coil forming station having support members configured and arranged to pass through the access openings in the shelf; and c) a mechanism for vertically adjusting the elevator platform to move its support members through the access openings in the shelf between raised operative positions at which the support members project into the annular chamber to support a coil therein by the receipt of said rings through open upper end of the container, and an inoperative position beneath the shelf, resulting in the coil being deposited on the shelf.

14 Claims, 4 Drawing Sheets

COOLING POT WITH VERTICALLY ADJUSTABLE COIL PLATE

PRIORITY INFORMATION

This application claims priority to provisional application Serial No. 60/106,274 filed Oct. 30, 1998.

BACKGROUND OF THE INVENTION

1. Field of the Invention

This invention relates generally to rolling mills producing hot rolled steel products such as bars, rods and the like, and is concerned in particular to an improvement in the retarded cooling of such products in insulated containers commonly referred to as "pots".

2. Description of the Prior Art

It is known to form hot rolled steel products such as bars, rods and the like into helical ring formulations which are accumulated in coil form in insulated pots. The difficulty with such arrangements is that the vertical distance the rings travel as they descend into the pots varies considerably from the beginning to the end of a coil forming cycle. This varying drop distance adversely affects uniformity of ring distribution and density from the bottom to the top of the coil, thus contributing to coil instability while also disadvantageously increasing coil size.

The primary objective of the present invention is the provision of an improved pot and associated adjustable coil support which operate in concert to maintain the top of the coil being formed in the pot at an optimum substantially constant height. By doing so, ring density and distribution is optimized and maintained substantially constant from the bottom to the top of the coil, which in turn minimizes coil size while maximizing coil stability.

These and other objectives and advantages of the present invention will now be described in greater detail with reference to the accompanying drawings, wherein:

DETAILED DESCRIPTION OF PREFERRED EMBODIMENT

Figure 1:
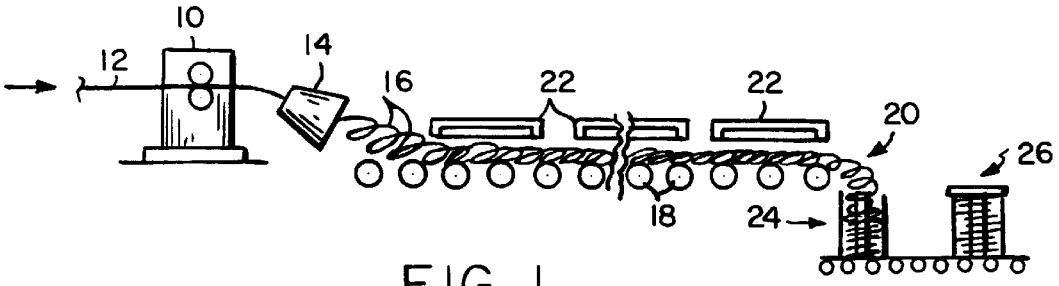
FIG. 1 is a diagrammatic illustration of the delivery end of a rod mill.

Referring initially to FIG. 1, the delivery end of a rolling mill is shown comprising a pinch roll unit 10 arranged to direct a hot rolled rod 12 or other like product into an inclined laying head 14 which forms the product into a continuous helical series of rings 16. The rings are received on a conveyor 18 on which they are carried forward in an overlapping nonconcentric arrangement towards a reforming station 20. Insulated covers 22 may overlie the conveyor to retard the cooling rate of the rings. At the coil forming station, the rings drop from the conveyor into an insulated portable container commonly referred to as a "pot" 24 where they gather into an upstanding cylindrical coil. As each pot is filled, it is shifted to an adjacent station 26 where the coils are allowed to cool at a retarded rate before eventually being removed from the pots.

Figure 3:
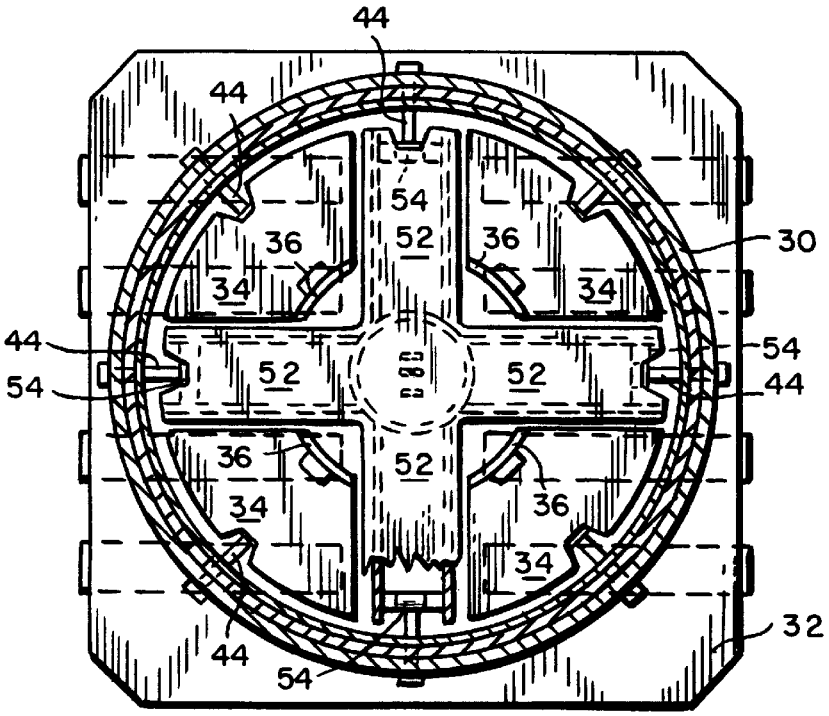
FIG. 3 is a horizontal sectional view taken along line 3—3 of FIG. 2.
Figure 2:
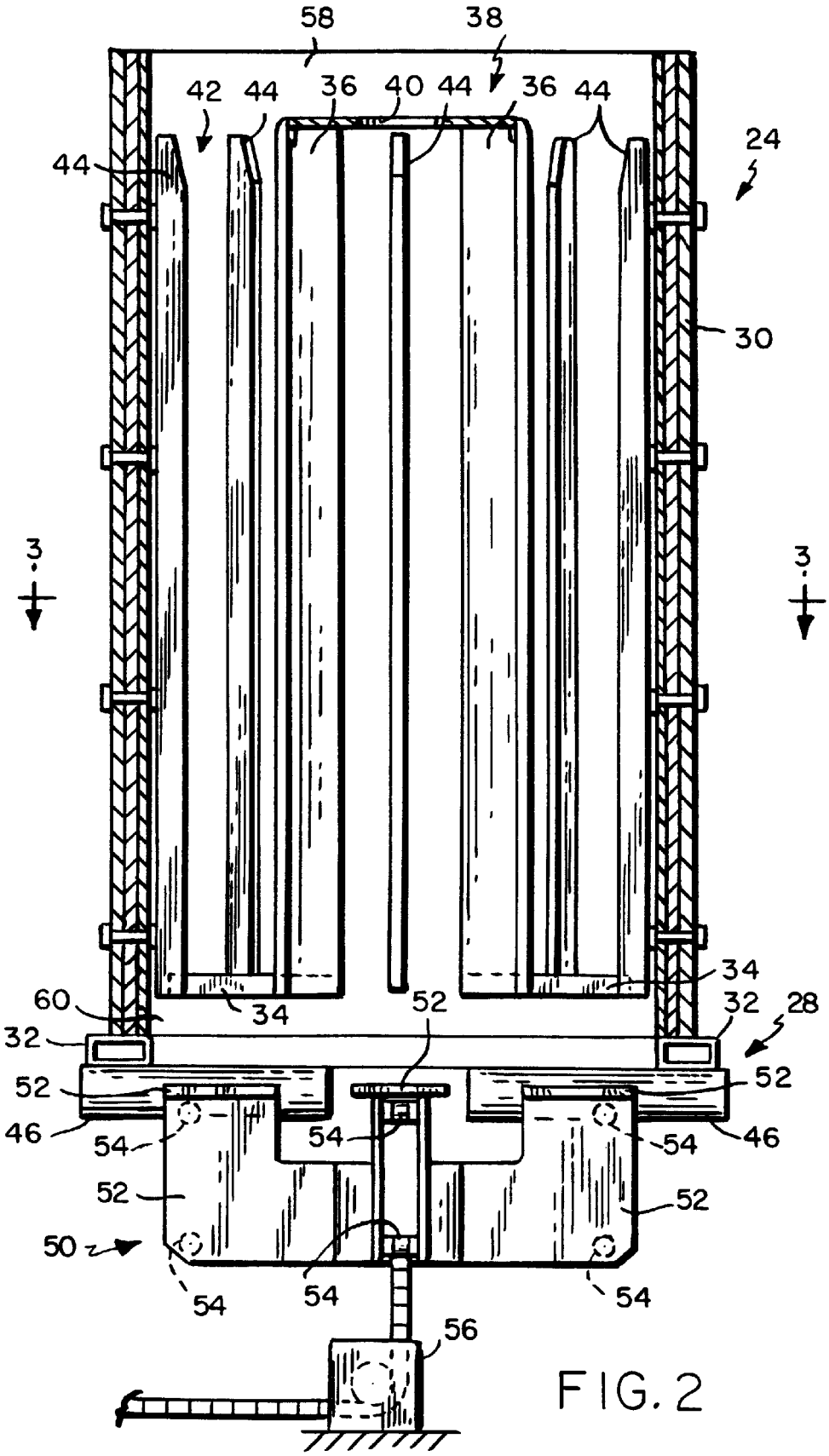
FIG. 2 is a vertical sectional view through the coil forming station shown in FIG. 1, with the elevator platform fully retracted below the level of the roller table.

With reference additionally to FIGS. 2 and 3, a pot 24 in accordance with the present invention is shown supported on a roller table 28 at the reforming station 20. The pot has a vertically disposed insulated side wall 30 open at its upper and lower ends. A frame-like base 32 with a central opening is configured to support the pot on the roller table. Truncated somewhat pie shaped segments 34 of a horizontal shelf project inwardly from the interior of the side wall. The inner ends of the shelf segments 34 support vertically extending accurate segments 36 of a central core 38. The core segments 36 are connected at their upper ends by a cap 40. The core 38 is centrally located and spaced inwardly from the interior of the side wall 30 to define an annular chamber 42 therebetween. The shelf segments 34 are circumferentially spaced one from the other to define access openings which communicate with vertical slots between the core segments 36.

Vertical rails indicated typically at 44 are secured to the interior of the side wall 30. The rails project radially inwardly into the annular chamber 42, and as will be explained hereinafter, serve to space the rings gathering in the pot from the interior of the side wall 30, thereby promoting uniform retarded cooling.

Figure 6:
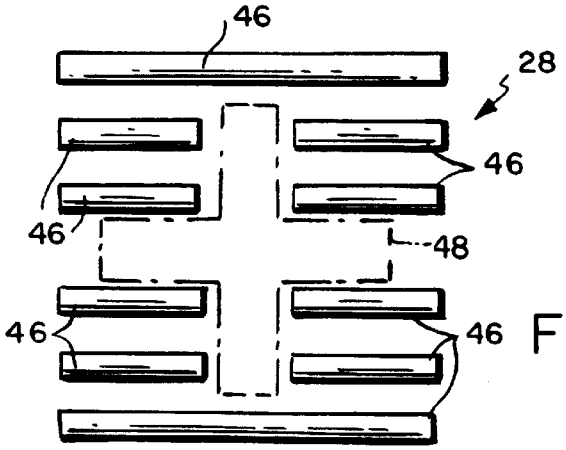
FIG. 6 is a diagrammatic plan view of the roller table at the reforming station.

As shown in FIG. 6, the rollers 46 of the roller table are spaced one from the other and configured to define a cross-shaped opening 48, the arms of which are aligned with the access openings between the shelf segments 34.

An elevator platform 50 is positioned beneath the roller table 28 for vertical adjustment through the cross-shaped opening 48. The elevator platform is generally in the shape of a cross, the arms 52 of which are provided with guide rollers 54. The crossed arms 52 are aligned with the cross-shaped opening 48 defined by the table rollers 46, as well as with the access openings between the shelf segments 34 and the vertical slots between the core segments 36. The elevator platform is vertically adjustable by an appropriate mechanism, one example being a thrust motion rigid chain drive 56 of the type supplied by Serapid USA, Inc. of Troy, Mich.

Figure 4:
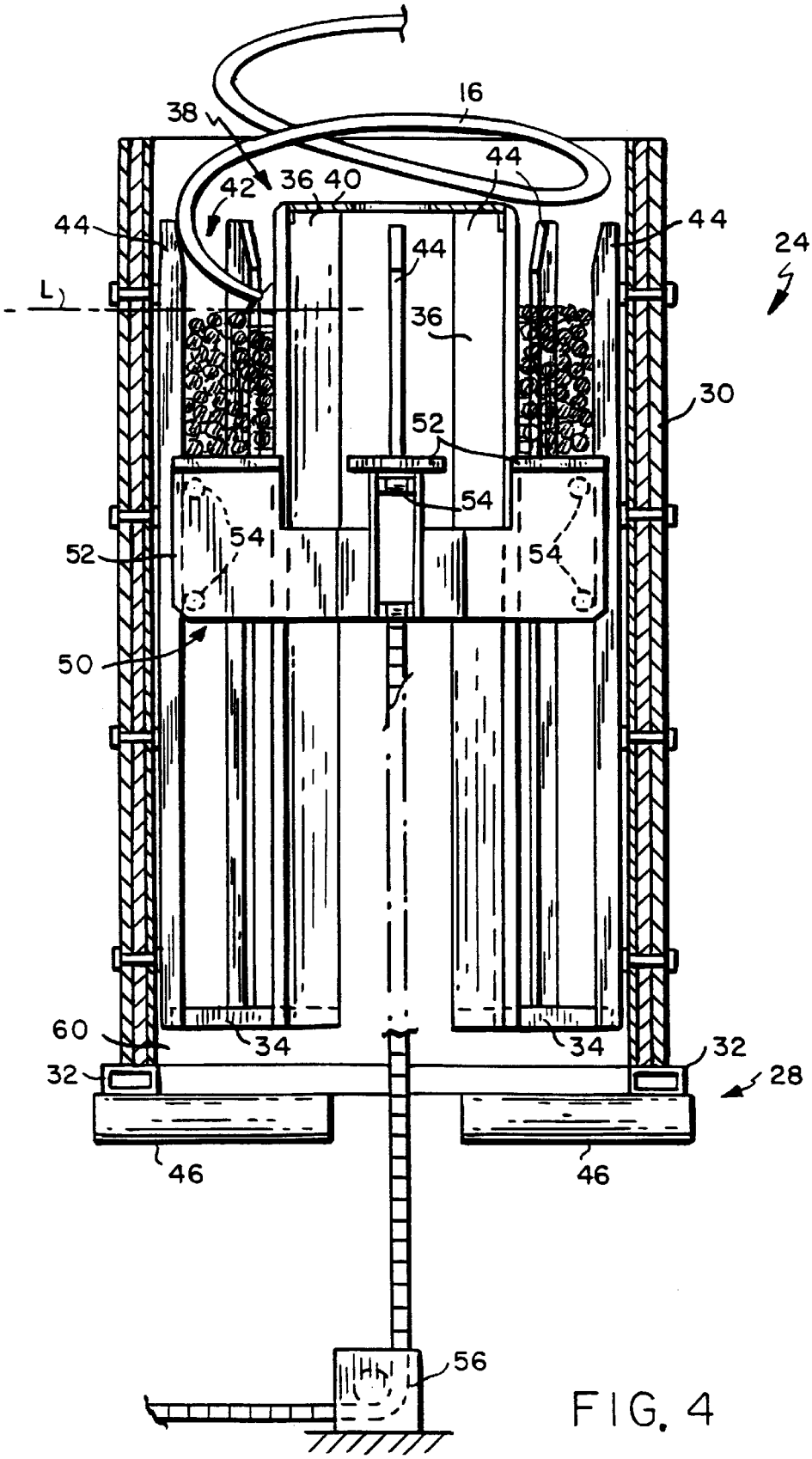
FIG. 4 is a view similar to FIG. 2 showing the elevator platform in a raised position during a coil forming operation.

In operation, as shown in FIG. 4, the elevator platform 50 is projected upwardly into the pot 24, with the rollers 54 coacting with selected rails 44 to provide a guiding function. Rings 16 are received through the open top of the pot. The rings are deposited on the raised platform 50 where they accumulate in coil form around the central core 38. The platform 50 is gradually lowered to maintain the top of the growing coil at an optimum level "L", thereby maintaining the drop distance of the rings substantially constant. At the end of the coil forming operation, the platform descends below the roller table, and in so doing transfers the coil into the shelf segments 34.

Figure 5:
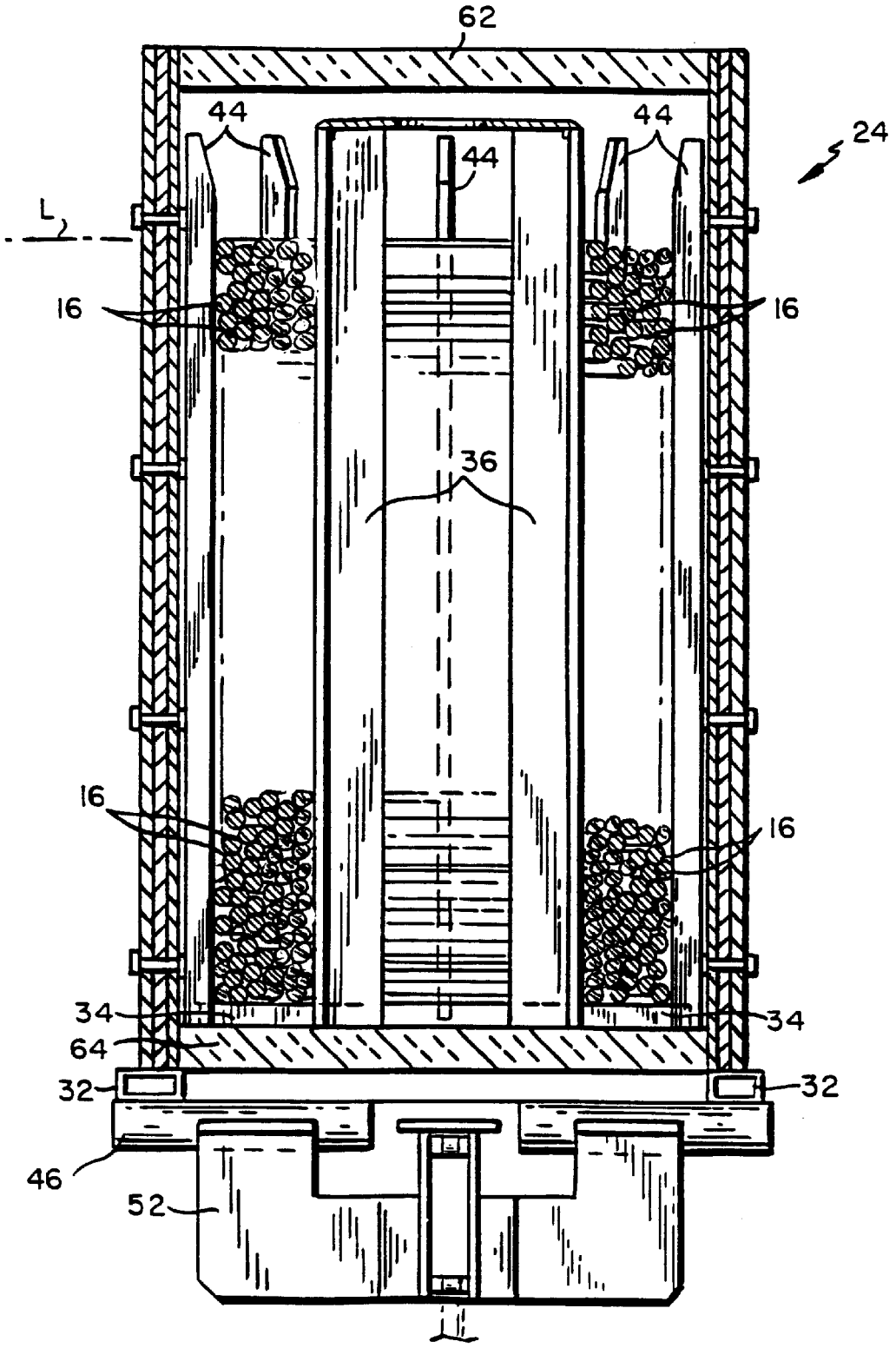
FIG. 5 is another view similar to FIG. 2 showing a fully formed coil contained in the pot with the insulated bottom and top covers in place.

It will be seen that the upper end of the central core 38 is spaced below the upper rim of the wall 30 to thereby define an upper recess 58. Similarly, the shelf segments 34 are spaced above the lower rim of the wall 30 to thereby define a lower recess 60. After the coil has been fully formed, as shown in FIG. 5, insulated top and bottom covers 62, 64 are positioned respectively in the upper and lower recesses 58, 60 to fully enclose the coil within the pot.

It is our intention to cover all changes and modifications to the above described apparatus which do not depart from the spirit and scope of our invention as defined by the appended claims.

What is claimed is:

1. Apparatus for receiving a continuous series of rings of a hot rolled product, said apparatus comprising:

a) a portable container having:

i) a vertically disposed cylindrical side wall open at its upper and lower ends;

ii) a base at the lower end of said side wall configured to removably locate said container at a coil forming station;

iii) a horizontal shelf projecting inwardly from the interior of said side wall; and iv) a central core supported by said shelf, said core being fixed with respect to and being spaced inwardly from the interior of said side wall to define an annular chamber therebetween, said shelf having access openings therein communicating with said chamber;

b) an elevator platform at said coil forming station, said elevator platform having support members configured and arranged to pass through the access openings in said shelf; and c) means for vertically adjusting said elevator platform to move said support members through the access openings in said shelf between raised operative positions at which said support members project into said chamber to support a coil being formed therein by the receipt of said rings through said open upper end, and an inoperative position beneath said shelf, resulting in said coil being deposited on said shelf.

2. The apparatus as claimed in claim 1 wherein said shelf is comprised of circumferentially spaced segments defining said access openings therebetween.

3. The apparatus as claimed in claim 2 wherein said core comprises mutually spaced ribs supported by and extending vertically from said shelf segments.

4. The apparatus as claimed in claim 3 wherein said ribs are interconnected at their upper ends by a cap.

5. The apparatus as claimed in claim 4 wherein said cap is spaced below the upper edge of said side wall to define an upper recess configured and arranged to removably receive an insulated top cover.

6. The apparatus as claimed in claim 1 wherein said shelf is spaced above the lower end of said side wall to define a lower recess configured and arranged to removably receive an insulated bottom cover.

7. The apparatus as claimed in claim 1 wherein said base is supported on a roller conveyor at said reforming station, said roller conveyor having rollers configured and arranged to provide openings therebetween aligned with the access openings in said shelf.

8. The apparatus as claimed in claim 1 further comprising rail members protruding from the interior of said side wall into said chamber, said rail members being configured and arranged to define a space between the exterior of said coil and the interior of said side wall.

9. The apparatus as claimed in claim 8 wherein said elevator platform is guided by said rail members during its vertical adjustment.

10. Apparatus for receiving a continuous series of rings of a hot rolled product, said apparatus comprising:

a) a portable container having:

i) a vertically disposed cylindrical side wall open at its upper and lower ends;

ii) a base at the lower end of said side wall configured to removably locate said container at a coil forming station;

iii) a horizontal shelf projecting inwardly from the interior of said side wall;

iv) a central core supported by said shelf, said core being spaced inwardly from the interior of said side wall to define an annular chamber therebetween, said shelf being comprised of circumferentially spaced segments defining access openings therebetween communicating with said chamber, said core comprising mutually spaced ribs supported by and extending vertically from said shelf segments; and v) a cap interconnecting the upper ends of said ribs, said cap being spaced below the upper edge of said side wall to define an upper recess configured and arranged to removably receive an insulated top cover;

b) an elevator platform at said coil forming station, said elevator platform having support members configured and arranged to pass through the access openings in said shelf; and c) means for vertically adjusting said elevator platform to move said support members through the access openings in said shelf between raised operative positions at which said support members project into said chamber to support a coil being formed therein by the receipt of said rings through said open upper end, and an inoperative position beneath said shelf, resulting in said coil being deposited on said shelf.

11. Apparatus for receiving a continuous series of rings of a hot rolled product, said apparatus comprising:

a) a portable container having:

i) a vertically disposed cylindrical side wall open at its upper and lower ends;

ii) a base at the lower end of said side wall configured to removably locate said container at a coil forming station;

iii) a horizontal shelf projecting inwardly from the interior of said side wall, said shelf being spaced above the lower end of said side wall to define a lower recess configured and arranged to removably receive an insulated bottom cover; and iv) a central core supported by said shelf, said core being spaced inwardly from the interior of said side wall to define an annular chamber therebetween, said shelf having access openings therein communicating with said chamber;

b) an elevator platform at said coil forming station, said elevator platform having support members configured and arranged to pass through the access openings in said shelf; and c) means for vertically adjusting said elevator platform to move said support members through the access openings in said shelf between raised operative positions at which said support members project into said chamber to support a coil being formed therein by the receipt of said rings through said open upper end, and an inoperative position beneath said shelf, resulting in said coil being deposited on said shelf.

12. Apparatus for receiving a continuous series of rings of a hot rolled product, said apparatus comprising:

a) a portable container having:

i) a vertically disposed cylindrical side wall open at its upper and lower ends;

ii) a base at the lower end of said side wall configured to removably locate said container at a coil forming station;

iii) a horizontal shelf projecting inwardly from the interior of said side wall; and iv) a central core supported by said shelf, said core being spaced inwardly from the interior of said side wall to define an annular chamber therebetween, said shelf having first openings therein communicating with said chamber;

b) a roller conveyor for supporting the base of said container at said reforming station, said roller conveyor having rollers configured and arranged to provide second openings therebetween aligned with the first openings in said shelf;

c) an elevator platform at said coil forming station, said elevator platform having support members configured and arranged to pass through said first and second openings; and d) means for vertically adjusting said elevator platform to move said support members through said first and second openings between raised operative positions at which said support members project into said chamber to support a coil being formed therein by the receipt of said rings through said open upper end, and an inoperative position beneath said shelf, resulting in said coil being deposited on said shelf.

13. Apparatus for receiving a continuous series of rings of a hot rolled product, said apparatus comprising:

a) a portable container having:

i) a vertically disposed cylindrical side wall open at its upper and lower ends;

ii) a base at the lower end of said side wall configured to removably locate said container at a coil forming station;

iii) a horizontal shelf projecting inwardly from the interior of said side wall; and iv) a central core supported by said shelf, said core being spaced inwardly from the interior of said side wall to define an annular chamber therebetween, said shelf having access openings therein communicating with said chamber;

b) an elevator platform at said coil forming station, said elevator platform having support members configured and arranged to pass through the access openings in said shelf;

c) means for vertically adjusting said elevator platform to move said support members through the access openings in said shelf between raised operative positions at which said support members project into said chamber to support a coil being formed therein by the receipt of said rings through said open upper end, and an inoperative position beneath said shelf, resulting in said coil being deposited on said shelf; and d) rail members protruding from the interior of said side wall into said chamber, said rail members being configured and arranged to define a space between the exterior of said coil and the interior of said side wall.

14. Apparatus for receiving a continuous series of rings of a hot rolled product, said apparatus comprising:

a) a portable container having:

i) a vertically disposed cylindrical side wall open at its upper and lower ends;

ii) a base at the lower end of said side wall configured to removably locate said container at a coil forming station;

iii) a horizontal shelf projecting inwardly from the interior of said side wall; and iv) a central core supported by said shelf, said core being spaced inwardly from the interior of said side wall to define an annular chamber therebetween, said shelf having access openings therein communicating with said chamber;

b) an elevator platform at said coil forming station, said elevator platform having support members configured and arranged to pass through the access openings in said shelf;

c) means for vertically adjusting said elevator platform to move said support members through the access openings in said shelf between raised operative positions at which said support members project into said chamber to support a coil being formed therein by the receipt of said rings through said open upper end, and an inoperative position beneath said shelf, resulting in said coil being deposited on said shelf; and d) rail members protruding from the interior of said side wall into said chamber, said rail members being configured and arranged to define a space between the exterior of said coil and the interior of said side wall, said platform being guided by said rail members during its vertical adjustment.

* * * * *